United States Patent [19]

Lin

[11] Patent Number: 4,459,322

[45] Date of Patent: Jul. 10, 1984

[54] METHOD FOR PRODUCING CATHODE STRUCTURE FOR CATHODE RAY TUBES UTILIZING UREA-CONTAINING SLURRY

[75] Inventor: San S. Lin, Seneca Falls, N.Y.

[73] Assignee: North American Philips Consumer Electronics Corp., New York, N.Y.

[21] Appl. No.: 335,302

[22] Filed: Dec. 28, 1981

[51] Int. Cl.[3] ..... B05D 5/12

[52] U.S. Cl. ..... 427/77; 427/126.1; 427/126.3; 427/380; 445/50; 445/51; 313/346 R

[58] Field of Search ..... 427/77, 78, 126.1, 126.3, 427/372.2, 373, 380; 445/50, 51; 313/346 R

[56] References Cited

U.S. PATENT DOCUMENTS

| | | | |
|---|---|---|---|
| 2,985,548 | 5/1961 | Blickwedel et al. | 427/77 |
| 3,536,526 | 10/1970 | Month | 427/77 |
| 4,210,839 | 7/1980 | Hagen | 427/77 |

OTHER PUBLICATIONS

Condensed Chemical Dictionary, Van Nostrand Reinhold Co., N.Y. ©1966, p. 994.

Kohl, W. H., Materials and Techniques for Electron Tubes, Reinhold Publishing Corp., N.Y. ©1960, pp. 551–557.

*Primary Examiner*—Michael R. Lusignan
*Assistant Examiner*—Richard Bueker
*Attorney, Agent, or Firm*—Thomas A. Briody; Jack Oisher; John C. Fox

[57] ABSTRACT

Cathode structures for cathode ray tubes are produced by dispensing slurry drops of cathode material onto metallic supporting substrates, and drying the drops to form cathode layers. The slurry comprises the particles in an organic binder solution, and additionally contains particles of urea. The cathode layers are subjected to further thermal processing during their incorporation into a cathode ray tube, and are characterized by a high degree of adherence to their underlying substrates.

7 Claims, 3 Drawing Figures

METHOD FOR PRODUCING CATHODE STRUCTURE FOR CATHODE RAY TUBES UTILIZING UREA-CONTAINING SLURRY

CROSS-REFERENCE TO RELATED APPLICATIONS

Concurrently filed application Ser. No. 335,301, filed 12-28-81, entitled "Depression Cathode Structure For Cathode Ray Tubes Having Surface Smoothness And Method For Producing Same", bearing the same Assignee, claims depression cathode structures produced from liquid cathode material.

Concurrently filed applications Ser. Nos. 335,298 and 335,300 filed 12-28-81, entitled "Slurry Method For Producing Cathode Structure For Cathode Ray Tubes", bearing the same Assignee, claims cathode structures produced from critically formulated slurry of cathode material.

Concurrently filed application Ser. No. 335,299, filed 12-28-81, entitled "Method Of Introducing A Porous Structure Into Film Cathode Coatings", bearing the same Assignee, claims porous cathode structures produced from film cathode material.

BACKGROUND OF THE INVENTION

1. Field of the Invention

This invention relates to cathode structures for cathode ray tubes, and more particularly relates to a method for producing such structures from slurry compositions of cathode material containing urea.

2. Prior Art

Cathode structures for cathode ray tubes desirably exhibit uniform electron emissions over an extended life cycle and under a variety of operating conditions. In addition, such cathode structures must be manufactured at the lowest possible cost. Because of such stringent requirements, particularly reliability and cost, there is great reluctance on the part of high volume manufacturers of cathode ray tubes to introduce new cathode structures or methods. Nevertheless, presently used cathode structures and methods exhibit limitations sufficiently troublesome to justify continuing investigations of alternate structures and methods.

One such limitation is poor adherence of the emissive layer to its substrate.

Adherence problems arise, particularly during operation near the high end of the normal temperature range, and can appear as lifting, flaking, or blistering of the emissive coating. Such adherence problems may be due in part to incomplete contact between relatively porous sprayed coatings and the underlying substrate. Such poor adherence can contribute to lower emmision and shorter life of the cathode.

Slurry cathode coatings are known, having been described in U.S. Pat. No. 4,170,811. Therein, accurate alignment of the cathode coating with the electron gun apertures is achieved by inserting a dispensing tube through the grid apertures and depositing a slurry droplet on a supporting substrate much larger than the droplet, and allowing the droplet to spread and dry in an uncontrolled manner. Because the grid and substrate have already been assembled prior to slurry application, and because there is little control over the thickness of the cathode layer, there is also little control over the K-$G_1$ spacing and cut-off voltage.

In co-pending U.S. Patent Application Ser. No. 335,300, referred to above, cathode structures are produced by dispensing drops of a slurry of controlled viscosity and concentration of cathode particles onto a substrate, and drying the drop without spreading to achieve a cathode layer of controlled density, thickness, and surface smoothness. Such structures exhibit good adherence between the cathode layer and substrate and uniformity of electron emissions, as well as enabling close control over K-$G_1$ spacings in electron gun structures for cathode ray tubes. However, in certain instances too rapid removal of organic binder material from the relatively dense dried cathode layer can weaken the layer or otherwise deleteriously affect its adherence to the underlying substrate.

Accordingly, objectives of the present invention include: providing an improved slurry method for producing cathode structures for cathode ray tubes whose cathode layers exhibit improved adherence to their supporting substrates.

SUMMARY OF THE INVENTION

In accordance with the invention, an improved slurry composition contains urea, as a minor constituent, the presence of which apparently facilitates the removal of the organic binder residue from the dried cathode layer without weakening the layer, and results in improved adherence of the cathode layer to its underlying substrate.

In accordance with the broad aspects of the invention, there is provided a method for producing a cathode structure for cathode ray tubes, the method comprising: providing a supporting substrate of a metallic material; dispensing a drop of a slurry of particles of potentially electron emissive material in a liquid support vehicle onto the substrate, the slurry having a viscosity within the range of about 2 to 6 centipoises; and drying the slurry without substantial spreading of the drop and to form a cathode layer of the particles adherent to the substrate, characterized in that the slurry additionally contains particles of urea as a minor constituent.

In accordance with a preferred embodiment of the invention, the urea is present in the slurry in the amount of about 0.05 to 30 milligrams per milliliter of liquid support vehicle.

Such liquid support vehicle comprises an effective amount of an organic binder such as nitrocellulose lacquer dissolved in a volatile organic solvent, and may additionally contain one or more diluents immiscible with the solvent.

The potentially emissive material is preferably present in the slurry in the amount of about 0.15 to 0.60 grams per milliliter of liquid support vehicle.

The solid inorganic particles from which the electron emissive material is formed consists essentially of a mixture, usually coprecipitated, of particles of alkaline earth carbonate selected from the group consisting of Ba, Sr and Ca carbonates.

Preferably, barium carbonate is present in the amount of about 55 to 60 weight percent, strontium carbonate is present in the amount of about 36 to 45 weight percent, and calcium carbonate is present in the amount of about 0 to 4 weight percent.

In accordance with still another preferred embodiment, following drying of the cathode layer, the structure is: first heated to a temperature sufficient to substantially convert the alkaline earth carbonates to alkaline earth oxides and to substantially remove organic binder residue; and then heated in a vacuum at a higher temperature, such higher temperature sufficient to activate the cathode structure by reducing at least a portion of the alkaline earth oxides to base metal, and to sinter at least a portion of the particles to each other and to the substrate.

DESCRIPTION OF THE PREFERRED EMBODIMENTS

Figure 1:
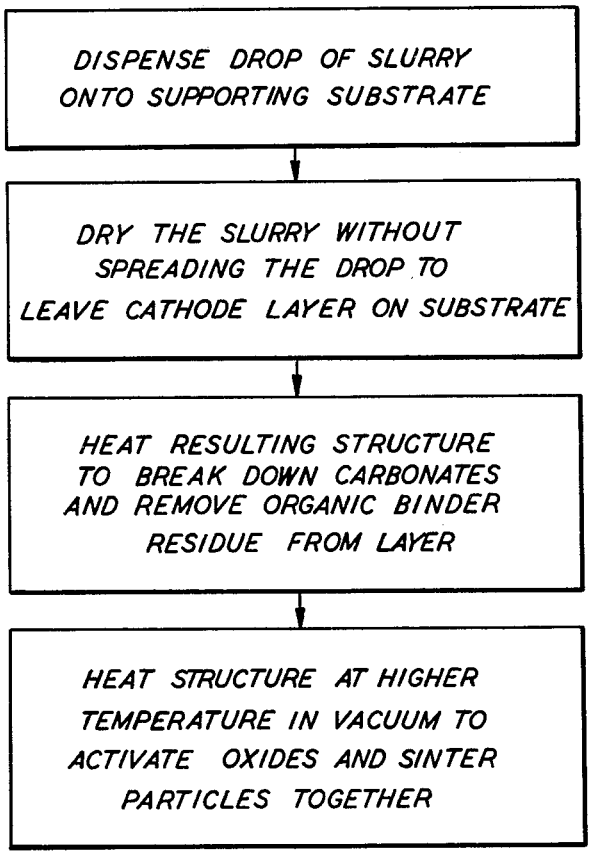
FIG. 1 is a block flow diagram illustrating one embodiment of a method for producing the cathode structure of the invention.

Referring now to FIG. 1, a block flow diagram illustrating one embodiment of the method of the invention, it is seen that a drop of slurry is dispensed onto a supporting substrate. The substrate is typically composed of an alloy of nickel typically containing about 2 to 4 weight percent tungsten, up to about 0.1 weight percent zirconium, remainder substantially nickel. Typical commercial alloys used for this purpose are known by the trade names "Nitung 4", having a composition of about 96 weight percent nickel, 4 weight percent tungsten, and "Nizir-W", having a composition of about 98 weight percent nickel, about 2 weight percent tungsten, and about 0.05 weight percent zirconium.

The slurry is a suspension of solid particles of potentially electron emissive material in a liquid support vehicle, usually formed by the addition of the solid particles to the liquid support vehicle, followed by ball milling or vigorous agitation. The solid particles of potentially emissive material are preferably present in the slurry in the amount of about 0.15 to 0.60 grams per milliliter of liquid support vehicle. Such a liquid slurry is characterized by a combination of surface wetting and surface tension values which allow ease of handling and application without substantial spreading on the substrate surface.

The liquid support vehicle may be any liquid not having solvent properties toward the particles, but having the desired surface wetting and surface tension properties, and sufficient volatility to enable its substantial and ready removal during drying. Such support vehicle also preferably includes a less volatile constituent having adhesive qualities which can serve as a temporary binder for the particles, and can be removed by subsequent thermal processing. Typical support vehicle binders could include acrylic, ethyl cellulose and nitrocellulose-type compositions.

The preferred liquid support vehicle is composed of a nitrocellulose type lacquer in tetrahydrofuran. The lacquer is a solution of a nitrocellulose-based composition in a solvent, such as amyl acetate or butyl acetate. Typically, the lacquer solution contains from about 2.6 to 2.8 weight percent of the nitrocellulose-based composition, which functions as a temporary binder for the solid particles after removal of the solvent by drying, and prior to its own removal during subsequent thermal processing. The tetrahydrofuran functions as a solvent or "thinner" for the lacquer, to achieve the desired viscosity for application of the slurry to the substrate. For this purpose, it has been found that the liquid support vehicle should be about 1.2 to 35 volume percent lacquer, remainder tetrahydrofuran.

In addition to the binder and solvent constituents, the liquid support vehicle may also contain one or more diluents immiscible with the solvent, such as toluene or xylene, to increase porosity of the dried cathode layer. Such additives could be present in the amount of about 8 to 12 volume percent.

Figure 2:
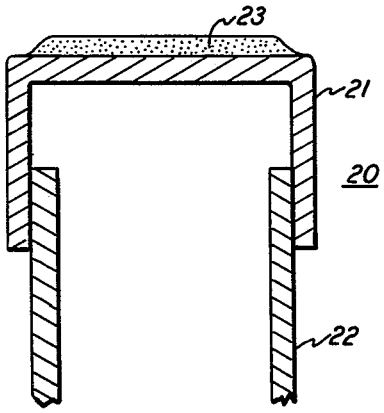
FIG. 2 is a section view of one embodiment of a cathode structure produced by the method of the invention in which the upper surface of the supporting substrate is flat.
Figure 3:
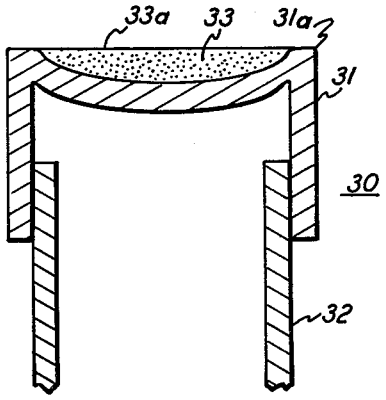
FIG. 3 is a section view of another embodiment of a cathode structure produced by the method of the invention, in which the upper surface of the supporting substrate contains a concave depression.

The slurry is dispensed in the form of a drop from a hypodermic needle or other microdispenser. The slurry is then substantially completely dried without substantial spreading of the drop, resulting in a cathode layer of potentially electron emissive material on the substrate. In FIG. 2, the cathode layer 23 is substantially flat and coplanar with the underlying planar substrate 21, while in FIG. 3. the cathode layer 33 fills a concave depression in substrate 31, but the upper surface of the cathode layer **33*a* is flat and coplanar with the surrounding substrate surface 31*a*. Of course, other embodiments are possible. Co-pending U.S. Patent Application Ser. No. 335,301**, referred to above entitled "Depression Cathode Structures For Cathode Ray Tubes Having Surface Smoothness And Method For Producing Same", and assigned to the present Assignee, describes structures in which the upper cathode surface may be grooved, or concavo-convex, as well as flat.

The following example is presented to illustrate the advantages of the invention.

Example

A mixture was prepared having the following composition:

- 15.3 grams of a co-precipitated mixture of about 57.2 weight percent $BaCO_3$, 4.0 weight percent $CaCO_3$, 0.22 weight percent Na and 38.8 weight percent $SrCO_3$.
- 5.4 milligrams urea
- 5.4 milliliters nitrocellulose lacquer (2.7 percent by weight nitrocellulose in butyl acetate).
- 34 milliliters tetrahydrofuran
- 14 milliliters butyl acetate
- 6.6 milliliters toluene The mixture was rolled slowly in a 239 milliliter ball mill for about 28 hours to form a slurry. Drops of the slurry were dispensed in concave depressions on cathode caps and dried at room temperature, to give smooth cathode layers about 2.4 mils thick.

Samples were tested for adherence of the cathode layer by heating under vacuum, by inserting a filament heater under the substrate in a bell jar at $10^{-5}$ mm Hg and varying the temperature by changing the heater voltage as follows: bring gradually to 6 volts and hold for 1 min., then 7 to 7.5 volts for 3 mins., then 9 volts for 1 min., then 11.5 volts for 1 min., then 7 volts for 3 mins. Such schedule produced conditions substantially equivalent to breakdown and activation during cathode ray tube manufacture. All samples passed the test, slightly more severe than that used for conventional sprayed coatings, while the conventional sprayed coatings cracked under the test.

The adherence of the cathode layers was then further tested by shock impact with a 25.9 gram weight, attached to 10.2 centimeter string swung through a 90° arc. All samples passed the test, while conventional sprayed coatings were knocked out of the depressions.

As will be appreciated by those skilled in the art, the described method is highly susceptible to automation techniques. For example, cathode substrates can be continuously indexed under a slurry dispensing location, at which location drops of slurry material are dispensed sequentially onto the surfaces of the indexing substrates; and finally passed through one or more controlled drying stations.

The dried cathode layer contains "potentially emissive" material, so referred to because only subsequent processing renders the material electron emissive. Such processing normally takes place during and immediately after evacuation of the cathode ray tube after sealing of the electron gun in the tube. Such processing is referred to as "breakdown" and "activation", wherein during tube evacuation the alkaline earth carbonates are broken down or thermally decomposed to the respective oxides, and subsequently the oxides are activated to base metal, in which form barium in particular is electron emissive. During heating to achieve breakdown, which normally occurs at a temperature of about 900° C., an organic binder residue is also removed from the cathode structure. During activation, which normally occurs at a temperature of about 1050° C., some sintering together of the remaining inorganic particles in the structure occurs, as well as some sintering of the particles to the substrate. Thus, a highly adherent cathode layer is formed. In addition to their adherence to the substrate, such layers are also characterized by a controlled density, thickness and surface smoothness, greater than can be achieved with any of the sprayed coatings now in use. Such controlled thickness and surface smoothness enable control of cathode-to-grid spacing, (and thus cut-off voltage), while controlled density and surface smoothness affect electron emissions.

INDUSTRIAL APPLICABILITY

Cathode structures described herein are particularly suitable for use in cathode ray tubes for color and black-and-white entertainment and data display applications.

I claim:

1. Method for producing a cathode structure for cathode ray tubes, comprising:

(a) providing a supporting substrate of a metallic material, (b) dispensing a drop of a slurry of particles of potentially electron emissive material in a liquid support vehicle onto the substrate, and (c) drying the slurry without substantial spreading of the drop and to form a cathode layer of the particles adherent to the substrate, characterized in that the slurry consists essentially of from about 0.15 to 0.60 grams of the potentially emissive material and from about 0.05 to 30 milligrams of urea particles per milliliter of the liquid support vehicle, and the liquid support vehicle consists essentially of from about 1.2 to 35 volume percent nitrocellulose lacquer, remainder tetrahydrofuran, wherein the nitrocellulose lacquer comprises from about 2.6 to 2.8 weight percent nitrocellulose in a solvent selected from at least one of amyl acetate and butyl acetate.

2. The method of claim 1 wherein the liquid support vehicle additionally contains one or more diluents immiscible with the solvent.

3. The method of claim 1 wherein the potentially emissive material consists essentially of a mixture of particles of alkaline earth carbonates selected from the group consisting of Ba, Sr and Ca carbonates.

4. The method of claim 2 wherein Ba carbonate is present in the amount of about 55 to 60 weight percent, Sr carbonate is present in the amount of about 36 to 45 weight percent, and Ca carbonate is present in the amount of about 0 to 4 weight percent.

5. The method of claim 1 wherein following drying, the structure is: first heated to a temperature sufficient to substantially convert the alkaline earth carbonates to alkaline earth oxides and to substantially remove organic binder residue; and then heated in a vacuum at a higher temperature, such higher temperature sufficient to activate the cathode structure by reducing at least a portion of the alkaline earth oxides to base metal, and to sinter at least a portion of the particles to each other and to the substrate.

6. The method of claim 5 wherein such heating steps are carried out during incorporation of the cathode structure into a cathode ray tube.

7. The method of claim 1 wherein the liquid support vehicle additionally contains from about 8 to 12 percent by volume of at least one additive selected from toluene and xylene.

* * * * *